US005197293A

United States Patent [19]

Okamura et al.

[11] Patent Number: 5,197,293

[45] Date of Patent: Mar. 30, 1993

[54] METHOD OF CONTROLLING AN AIR CONDITIONING APPARATUS AND AIR CONDITIONING APPARATUS USING THE METHOD

[75] Inventors: Tetsunobu Okamura; Kiyoshi Nagasawa, both of Tochigi; Kuniyuki Yamada, Kashiwa, all of Japan

[73] Assignee: Hitachi, Ltd., Tokyo, Japan

[21] Appl. No.: 841,542

[22] Filed: Feb. 26, 1992

[30] Foreign Application Priority Data

Feb. 26, 1991 [JP] Japan ..... 3-053267

[51] Int. Cl.[5] ..... F25B 1/00

[52] U.S. Cl. ..... 62/228.4; 62/229; 165/30

[58] Field of Search ..... 62/228.1, 228.4, 228.5, 62/226, 229, 208, 209; 165/30

[56] References Cited

U.S. PATENT DOCUMENTS 4,407,139 10/1983 Ide et al. ..... 62/228.4 X
4,789,025 12/1988 Brandemuehl et al. ..... 165/30
4,918,932 4/1990 Gustafson et al. ..... 62/229 X

FOREIGN PATENT DOCUMENTS 0056035 3/1984 Japan ..... 62/228.4

*Primary Examiner*—Harry B. Tanner
*Attorney, Agent, or Firm*—Antonelli, Terry, Stout & Kruas

[57] ABSTRACT

The present invention provides a method of controlling an air conditioning apparatus and the air conditioning apparatus which uses the control method to set a difference between a room temperature and a temperature of a discharged air from the air conditioning apparatus at a appropriate value to provide pleasant cooling to an individual. The present invention controls the rotational speed of the compressor in accordance with the difference between an actual room temperature and a target room temperature and additionally controls the rotational speed of the compressor corresponding to the difference between the actually discharged air temperature from the compressor and a target discharge temperature of the compressor.

6 Claims, 5 Drawing Sheets

METHOD OF CONTROLLING AN AIR CONDITIONING APPARATUS AND AIR CONDITIONING APPARATUS USING THE METHOD

BACKGROUND OF THE INVENTION

The present invention relates to a method of controlling the operation of an air conditioning apparatus and an air conditioning apparatus controlled by this method, and more particularly, to a method and apparatus for controlling a cooling operation.

A conventional air conditioning apparatus is generally provided with a room temperature sensor such that a rotational speed of a compressor is controlled by the difference between an actual room temperature detected by the room temperature sensor and a target room temperature set by a user, whereby the room temperature is maintained at the target temperature. The rotational speed of the compressor is controlled in a PI (Proportional/Integration) control using the difference between the room temperature and the target room temperature and a changing rate of the room temperature.

In a cooling operation, the difference $\Delta T1$ between a room temperature and a target temperature is so large at the start-up time that a compressor is initially rotated at a maximum rotational speed, as shown in FIG. 1. For this reason, in the air conditioning apparatus, air is rapidly cooled down by a heat exchanger, so that a temperature of air discharged from the apparatus (a discharged air temperature) is rapidly cooled, whereby the room temperature is gradually lowered toward the target room temperature. When the room temperature comes close to the target room temperature, the rotational speed of the compressor is changed toward a minimum rotational speed by means of the PI control, and consequently the air conditioning apparatus is stably operated in vicinity of the target room temperature.

Meanwhile, the cooling operation of an air conditioning apparatus is performed in a manner so that cooled air thereby is discharged to a room to cool down the room, so that there may be a large difference between the actual room temperature and the discharged air temperature. For this reason, a person who is exposed to such cooled air blown from the air conditioning apparatus may feel chilly. Particularly, before the room temperature has reached the target room temperature, the difference between the room temperature and the discharged air temperature is extremely large.

Suppose, for example, that an actual room temperature is at 33° C. and a target room temperature is set to 27°C., as shown in FIG. 1. Then, the compressor is rotated at the maximum rotational speed with the start-up of the air conditioning apparatus, causing a discharged air temperature to abruptly drop to 14°C., whereby the room temperature is gradually lowered toward the target value. At this time, the difference between the room temperature and the discharged air temperature is 19° C. This means that a person, who has been accustomed to the room temperature of 33° C., is subject to air blown at the discharged air temperature at 14° C. which is 19° C. less than the room temperature, and will suffer from an excessive chill. Subsequently, the discharged air temperature is raised as the room temperature is cooled down. However, the compressor still maintains its rotation at the maximum value, and therefore the discharged air temperature will be merely slightly raised. Since the difference between the room temperature and the discharged air temperature is still great, the person, if exposed to such discharged air, will feel chilly. When the room temperature has reached the target value set at 27° C., the rotational speed of the compressor is dropped and operated so as to maintain the room temperature at the set target temperature. However, even in this situation, the discharged air temperature will be raised at most up to 18° C., where the difference between the room temperature and the discharged air temperature is still about 9° C. Therefore, the person, if exposed to a low temperature air for a long time, will suffer an unpleasant feeling or coldness.

As described above, with a conventional air conditioning apparatus, even if a target room temperature is set at a desired value, a temperature of a discharged air from the apparatus is significantly different from a room temperature, whereby blowing a low temperature air for a long time may result in spoiling a pleasant cooling feeling.

SUMMARY OF THE INVENTION

The present invention solves the above-mentioned problem, and its object is to provide a method of controlling an air conditioning apparatus and an air conditioning apparatus using this control method which can set the difference between a room temperature and a temperature of a discharged air from the air conditioning apparatus at an appropriate value to realize pleasant cooling effects.

To achieve the above object, the present invention not only controls a rotational speed of a compressor in accordance with the difference between an actual room temperature and a target room temperature, as does a conventional air conditioning apparatus, but also modifies the rotational speed of the compressor based on the difference between an actually discharged air temperature from the compressor and a set temperature value of the discharged air.

The method of controlling an air conditioning apparatus according to the present invention comprises the steps of the suction and cooling air in a room; measuring an air temperature in the room and a temperature of cooled air discharged to the room; determining a first difference value ($\Delta T1$) corresponding to the difference between the measured air temperature in the room and a target value of the room temperature; determining a second difference value ($\alpha \cdot \Delta T2$) corresponding to the difference between a target value of the discharged air temperature lower than the target value of the room temperature by a predetermined value and the measured value of the discharged air temperature; generating a control signal ($\Delta T$) corresponding to the difference between the first difference value ($\Delta T1$) and the second difference value ($\alpha \cdot \Delta T2$); and controlling a rotational speed of a compressor of the air conditioning apparatus in accordance with the value of the control signal ($\Delta T$) and the measured value of the air temperature in the room, so as to maintain the difference between the target value of the room temperature and the discharged air temperature to be a predetermined constant value.

The air conditioning apparatus for realizing the control method of the present invention is an air conditioning apparatus which utilizes a vapor compression cycle to cool a coolant and perform a heat exchange between air and the coolant through a heat exchanger to cool down the air, and comprises a first temperature sensor for measuring an air temperature in a room; a second temperature sensor for measuring air cooled by the air conditioning apparatus and discharged to the room; means for setting a target value for a room temperature and a target value for a temperature of air discharged to the room at a value lower than the target value for the room temperature by a predetermined value; means for determining a first difference value ($\Delta T1$) corresponding to the difference between the air temperature in the room measured by the first sensor and the target value for the room temperature indicated by the setting unit; means for determining a second difference value ($\alpha \cdot \Delta T2$) corresponding to a difference between the target value for the discharged air temperature indicated by the indicating unit and the discharged air temperature measured by the second temperature sensor; means for generating a control signal ($\Delta T$) corresponding to the difference between the first difference value and the second difference value; and a control unit for controlling a rotational speed of an compressor of the air conditioning apparatus in accordance with the value of the control signal ($\Delta T$) and the air temperature value in the room measured by the first temperature sensor to maintain the difference between the target value for the room temperature and the measured discharged air temperature to be a predetermined constant value.

When the person directly exposed to the discharged air from an air conditioning apparatus does not feel chilly or warm in a room maintained at a set temperature, the person can feel pleasantly cool. To satisfy such conditions, the air conditioning apparatus must be operated such that the discharged air temperature is lower than the room temperature by an appropriate value. If the discharged air temperature is set at such a point, a rotational speed of a compressor derived in accordance with the difference between the actual room temperature and the target room temperature is modified on the basis of the difference between the target discharged air temperature and the actual discharged air temperature to an optimal rotational speed, and the compressor is rotated at this modified rotational speed. The room temperature is consequently maintained in vicinity of the target room temperature, while the discharged air temperature is also maintained in vicinity of the target discharged air temperature.

DESCRIPTION OF THE PREFERRED EMBODIMENTS

Figure 2:
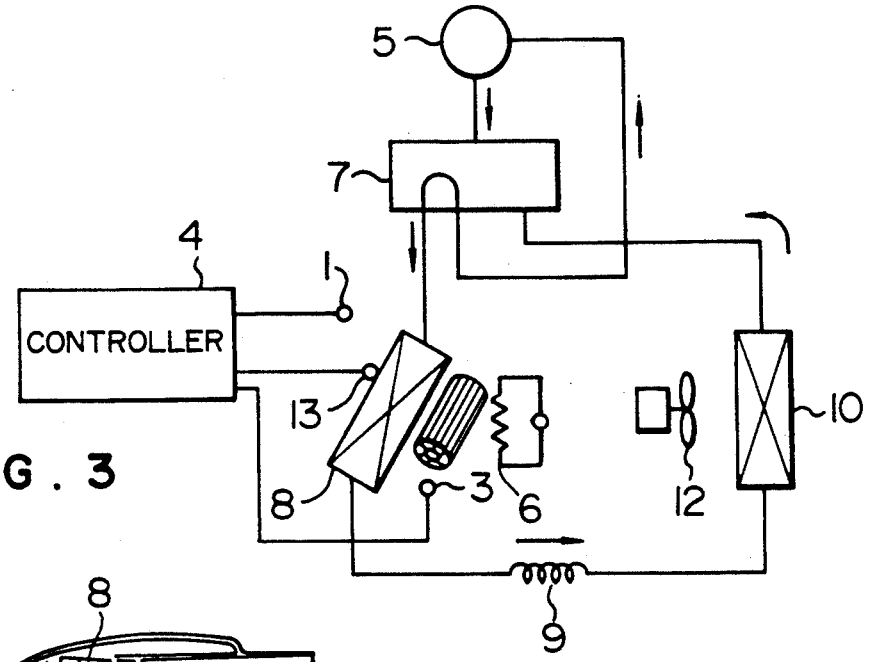
FIG. 2 is a diagram illustrating a cooling cycle to which the present invention is applied.

FIG. 2 illustrates an arrangement of a cooling cycle of an air conditioning apparatus utilizing a vapor compression cycle to which the present invention is applicable. This air conditioning apparatus is a type which can select one of a cooling operation or a heating operation by using a heat pump by switching a switching valve 7. Of course, the present invention can be applied also to an air conditioning apparatus exclusively used for cooling operation. In this embodiment, the explanation of the heating operation will be omitted, and a cooling operation will be only explained for the sake of simplicity. In the drawing, an arrow indicates a direction in which a coolant flows.

In FIG. 2, reference numeral 5 designates a compressor for compressing a coolant to convert the same to a high temperature and high pressure vapor; 7 designates the switching valve for switching the direction of the coolant; 8 designates an indoor heat exchanger; 9 designates a capillary, 10 an external heat exchanger; 6 designates a heater for heating air cooled by the heat exchanger 8 to some degree; 11 designates a sirocco fan driven by a motor, not shown, for emitting cooled air to a room; and 12 designates an external sirocco fan attached to the external heat exchanger 10. In addition to these components, temperature sensors are further provided for the air conditioning apparatus. Specifically, reference numeral 1 designates a temperature sensor such as a thermistor which may be located at an arbitrary point in a room or near an air suction port of the air conditioning apparatus for detecting an actual room temperature; 13 designates a heat exchanger temperature sensor located on the air suction side of the indoor heat exchanger 8, and 3 designates a discharged air temperature sensor located near a discharge port of cooled air.

Figure 3:
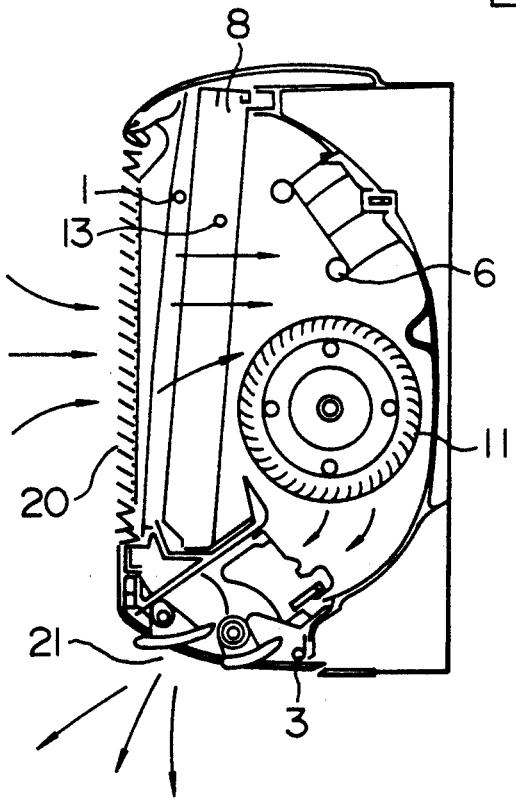
FIG. 3 is a cross-sectional view illustrating an air conditioning apparatus to which the present invention is applied.

FIG. 3 illustrates a cross-sectional view of the air conditioning apparatus of the present invention. When the cooling operation is started, the sirocco fan 11 is rotated to suction air in a room into an air suction port 20 as indicated by arrows. The suctioned air passes through the indoor heat exchanger 8 which removes the heat of the air by the coolant, and is cooled down and discharged from an air discharge port 21 into the room.

Figure 4:
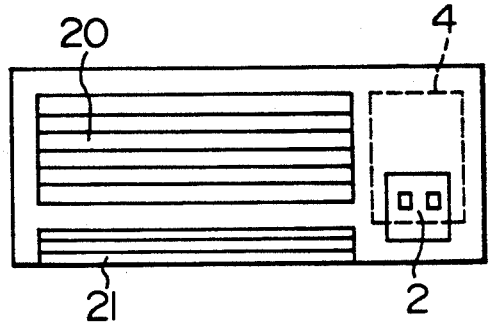
FIG. 4 is a front view of the air conditioning apparatus to which the present invention is applied.

FIG. 4 illustrates a front view of the air conditioning apparatus to which the present invention is applied. A manipulation panel 2 is arranged on the front of the apparatus for allowing an operator to set a room temperature at a desired value by manipulating knobs or the like, not shown, on the manipulation panel 2. Incidentally, the air conditioning apparatus may be controlled not only by this manipulation panel 2 provided in its body but by a remote control unit from a distant position. A controller 4 is built in the air conditioning apparatus body for performing an operation control, a temperature control and so on. It will be apparent to those skilled in the art that the air conditioning apparatus to which the present invention is relates is not limited to the shape and design as illustrated in the figures but can employ additional shapes or types.

Figure 5:
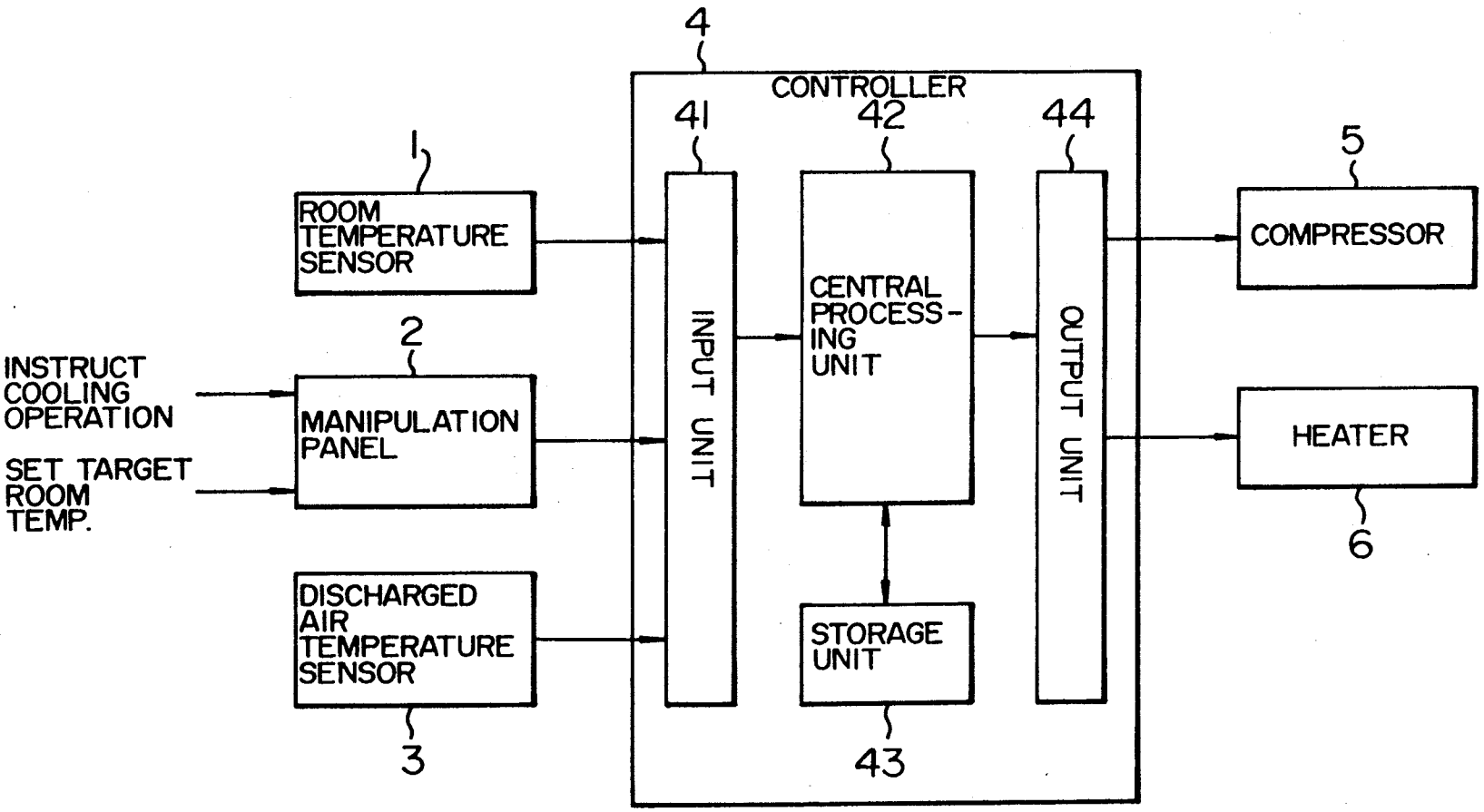
FIG. 5 is a block diagram illustrating the construction for embodying a control method according to the present invention.

FIG. 5 is a block diagram illustrating a connection relationship among the controller 4, the sensors, the compressor 5 and the heater 6. The controller 4 may utilize a known microcomputer. More specifically, the controller 4 comprises an input unit 41 for receiving a temperature signal generated from the room temperature sensor 1, a signal indicative of a target temperature value inputted from the manipulation panel 2, a temperature signal generated from the discharged air temperature sensor 3 converting the temperature to signals processable by a computer, a central processing unit 42 for performing logical processing and arithmetic operations in accordance with programs, a storage unit 43 including read only memories having a control program for the air conditioning apparatus stored therein and random access memories for temporarily storing data generated in course of processing the control program, and an output unit 44 for converting control signals generated by the central processing unit 42 to signals for controlling the compressor 5 and the heater 6.

As described above, the discharged air temperature sensor 3 is arranged near the discharge port of the air conditioning apparatus. When the target room temperature is determined by manipulating the manipulation panel 2, the controller 4 sets the target discharged air temperature at the temperature lower than the target room temperature by 5° C., and controls the rotational speed of the compressor 5 based on the actual room temperature detected by the room temperature sensor 1 and an actually discharged air temperature detected by the discharged air temperature sensor 3 so as to stabilize the room temperature in vicinity of the target room temperature as well as the discharged air temperature in vicinity of the target discharged air temperature. Also, the heater 6 arranged in the discharge port 4 has its conduction timing and conduction ratio controlled by the controller 4 such that the cooled air discharged from the discharge port 4 is heated.

The conduction ratio of the heater 6 may be controlled by making conductive and inconductive an SSR (not shown) connected in series to the heater 6 by means of a control signal.

The purpose of heating air cooled by the indoor heat exchanger 8 is as follows. Since cooled air after passing through the in-house heat exchanger 8 has a relative humidity of approximately 100%, it is necessary to heat such humid air to reduce the relative humidity and consequently blow off the dry air, thereby providing more pleasant cooling. In the present embodiment, the heater 6 is also utilized to raise the discharged air temperature, in addition to reducing the relative humidity.

Figure 6:
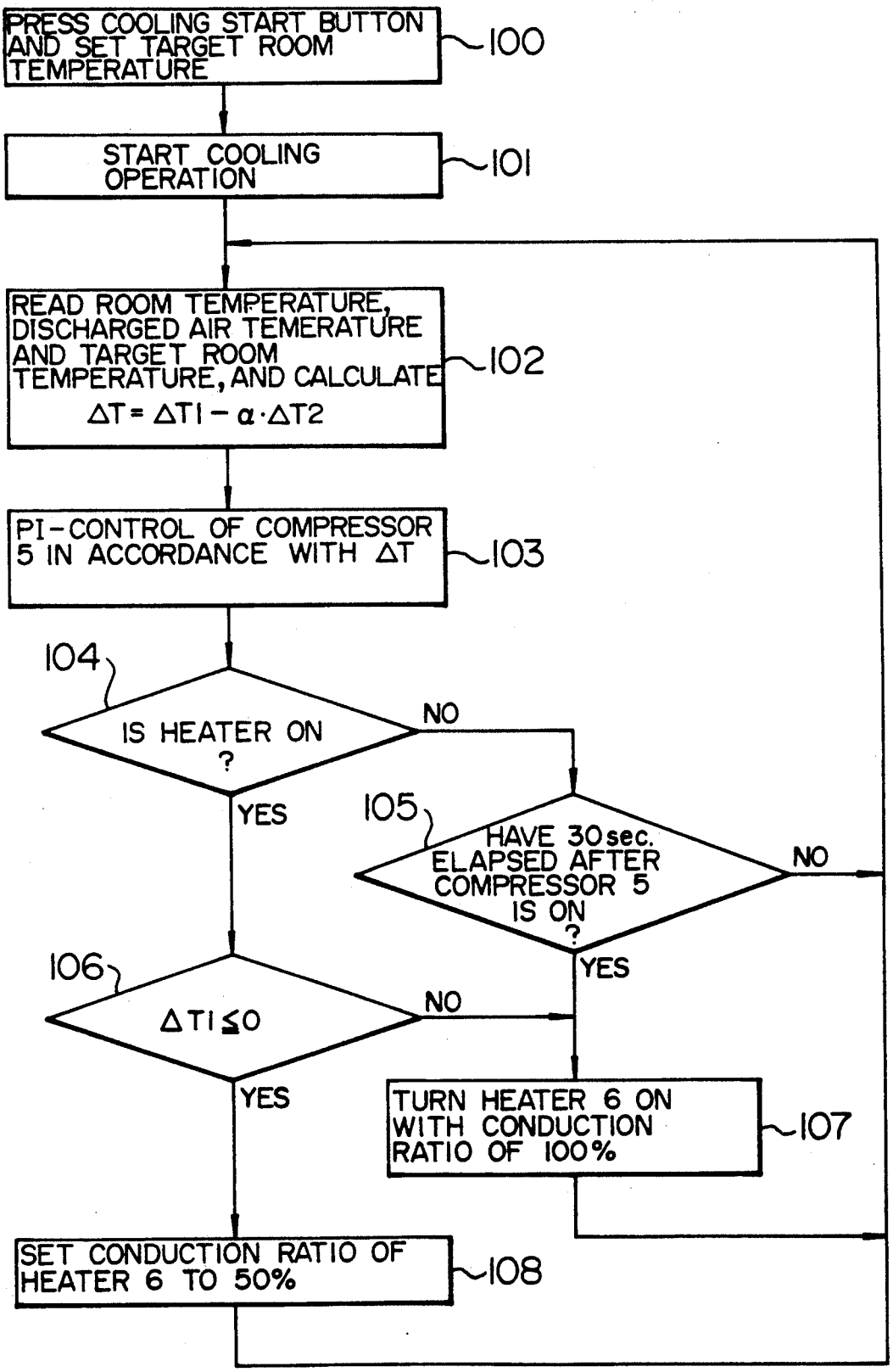
FIG. 6 is a flow chart illustrating an embodiment of the control method according to the present invention.

Next, the operation of the air conditioning apparatus, executed by the controller 4, will be described in reference to the flow chart of FIG. 6. A program for executing this control flow is stored in the storage unit 43 of the controller 4.

First, if a cooling operation button (not shown) is pressed at step 100, the controller 4 is initialized and the control program for the cooling operation is started, and the cooling cycle shown in FIG. 2 is simultaneously operated at step 101. Then, the detected room temperature from the room temperature sensor 1 and the detected discharged air temperature from the discharged air temperature sensor 3 as well as the target room temperature value from the manipulation panel 2 are respectively obtained to determine the target discharged air temperature at the value lower than the target room temperature by 5° C. Then, the difference ΔT1 between the actual room temperature and the target room temperature and the difference ΔT2 between the target discharged air temperature and the actually discharged air temperature are calculated, and subsequently the value ΔT is derived by the following equation (1) (at step 102):

$$\Delta T = \Delta T1 - \alpha \cdot \Delta T2 \qquad 1$$

(here, $0 < \alpha < 1$)

where $\alpha$ represents a weighting coefficient indicative of the extent the temperature difference value ΔT2 influences the temperature control for the air conditioning apparatus. Stated another way, a conventional air conditioning apparatus has performed a temperature control only by using ΔT1, whereas the present invention further employs ΔT2 as an additional control parameter.

The value $\alpha$ is arbitrarily selected between 0 and 1. This value may be fixed or maybe variable in accordance with the user's preference. For example, if the value ΔT1 does not approach to zero within a predetermined time, the value $\alpha$ is decreased to reduce the influence of ΔT2 on the temperature control, so as to bring the room temperature to a target temperature value more rapidly. This is a case where the cooling is given the first priority. On the other hand, the value may be increased in proportion to ΔT2. This is a case where a blown-off air temperature is low and is controlled to rapidly reach a target value with priority given to pleasant feeling.

The compressor 5 (FIG. 2) is started to initiate a PI control with the temperature difference ΔT derived by the above calculation (step 103). In accordance with this PI control for the compressor 5, the compressor 5 is rotated at a minimum rotational speed when $\Delta T \leqq 0$. As ΔT is positive and larger, the rotational speed of the compressor 5 is increased to cool a discharged air down to a lower temperature. Thus, rapidly cooled air is discharged from the air conditioning apparatus when a cooling operation is just started. The PI control will be described later in greater detail.

Next, it is determined whether or not the heater 6 (FIG. 2) is conducted or supplied with an electric power (at step 104). This conduction is performed after a predetermined time period has elapsed from the start-up of the compressor 5. This predetermined time period corresponds a time period required for a discharged air temperature to reach a minimum temperature and is set to 30 seconds in this embodiment. Since the heater 6 has not been conducted upon starting the compressor 5, it is determined whether or not 30 seconds have elapsed after the compressor 5 is started (step 105). The above-mentioned operation, steps 102–105, is repeated until the predetermined time period has elapsed. When 30 seconds have elapsed, conduction of the heater 6 is started with the conduction ratio being 100% (step 107). The conduction ratio is used herein as being related to a conduction time per half cycle of an alternate current supplied to the heater 6. The discharged air is heated by the heater 6, whereby the discharged air temperature rises gradually. Then, the operation is repeated again from step 102, however, since the heater 6 is now conducting, step 106 is executed as the result of the determination made at step 104. At step 106, it is determined whether or not the difference ΔT1 between the actual room temperature and the target room temperature is below 0. If not, a sequence of operations at steps 102, 103, 104, 106 and 107 are repeatedly executed until the temperature difference ΔT1 is below 0, whereby the PI control for the compressor 5 and the conduction of the heater 5 with the conduction ratio of 100% are performed in accordance with the temperature difference ΔT. Meanwhile, the actual room temperature gradually falls, approaching the target room temperature, while the discharged air temperature rises approaching the target discharged air temperature. For this reason, the rotational speed of the compressor 5 gradually decreases. Finally, the discharged air temperature reaches the target discharged air temperature. Subsequently, the discharged air temperature is maintained in vicinity of the target discharged air temperature by the PI control performed for the compressor 5 in accordance with the temperature difference ΔT.

Afterward, when the actual room temperature reaches the target room temperature and accordingly the condition $\Delta T1 \leqq 0$ stands (step 106), the conduction ratio of the heater 6 is reduced to 50% (step 108). Subsequently, the heater 6 conducts with the conduction ratio of 50% until the air conditioning apparatus is stopped or the target room temperature is changed, so that the compressor 5 is controlled to the PI manner in accordance with the temperature difference ΔT, with the result that a stable cooling operation is maintained with the room temperature and the discharged air temperature being stabilized in vicinity of the target room temperature and target discharged air temperature, respectively.

Next, the PI control performed at step 102 will be explained. A PI control is a known feedback process control which includes a proportion term and an integration term as control components for approaching a controlled amount to a target value. In the present invention, the PI control is performed for the rotational speed of the compressor as a controlled amount in accordance with the value ΔT and a room temperature value.

The proportion term is determined by the temperature difference ΔT. ΔT is sampled at predetermined intervals (for example, 16 times for two seconds), and the rotational speed is determined in accordance with a mean value of the sampled temperature differences ΔT. Specifically, a lookup table which represents the correspondence of mean values ΔT to rotational speed values may be previously prepared and stored in the storage unit 43 such that each time a mean value of ΔT is determined, this table is referenced to determine a rotational speed. Table 1 is an example of such a lookup table which represents the correspondence of mean values ΔT to rotational speed values. It should be noted that rotational speed values of Table 1 indicate values to be added to a minimum basic rotational speed (for example, 1000 rpm).

TABLE I

| TEMPERATURE DIFFERENCE T | ROTATIONAL SPEED |
|---|---|
| −1.25 | |
| −1.00 | 0 |
| −0.75 | 0 |
| −0.50 | 0 |
| −0.25 | 0 |
| 0.00 | 0 |
| 0.25 | 100 |
| 0.50 | 200 |
| 0.75 | 400 |
| 1.00 | 600 |
| 1.25 | 900 |
| 1.50 | 1200 |
| 1.75 | 1500 |
| 2.00 | 1800 |
| 2.25 | 2100 |
| 2.50 | 2400 |
| 2.70 | 2700 |
| 3.00 | 3000 |

TABLE I-continued

| TEMPERATURE DIFFERENCE T | ROTATIONAL SPEED |
|---|---|
| 3.25 | 3300 |
| 3.50 | 3600 |
| 3.75 | 3900 |
| 4.00 | 4200 |
| 4.25 | 4500 |
| 4.50 | 4800 |
| 4.75 | 5100 |
| 5.00 | 5400 |
| 5.25 | 5700 |
| 5.50 | 6000 |
| 5.75 | 6300 |
| 6.00 | 6600 |
| 6.25 | 6900 |
| 6.50 | 7200 |

Controlled Speed = above rotational speed + minimum rotational speed 100 rpm

Next, the integration term modifies the rotational speed in accordance with a temperature value detected by the room temperature sensor 1 in addition to ΔT. More specifically, a temperature detected by the room temperature sensor 1 is sampled at predetermined intervals (for example, every three minutes), the value of the integration term is increased or decreased in accordance with a previously detected temperature and a currently detected temperature. For example, if the difference between the previously detected temperature and the currently detected temperature is increased by more than 0.25° C., the rotational speed of the integration term is increased by 100 rpm. On the contrary, if the difference between the previously detected temperature and the currently detected temperature is decreased by more than 0.25° C., the rotational speed of the integration term is decreased by 200 rpm. If a temperature change is within ±0.25° C., the integration term is not modified.

Figure 7:
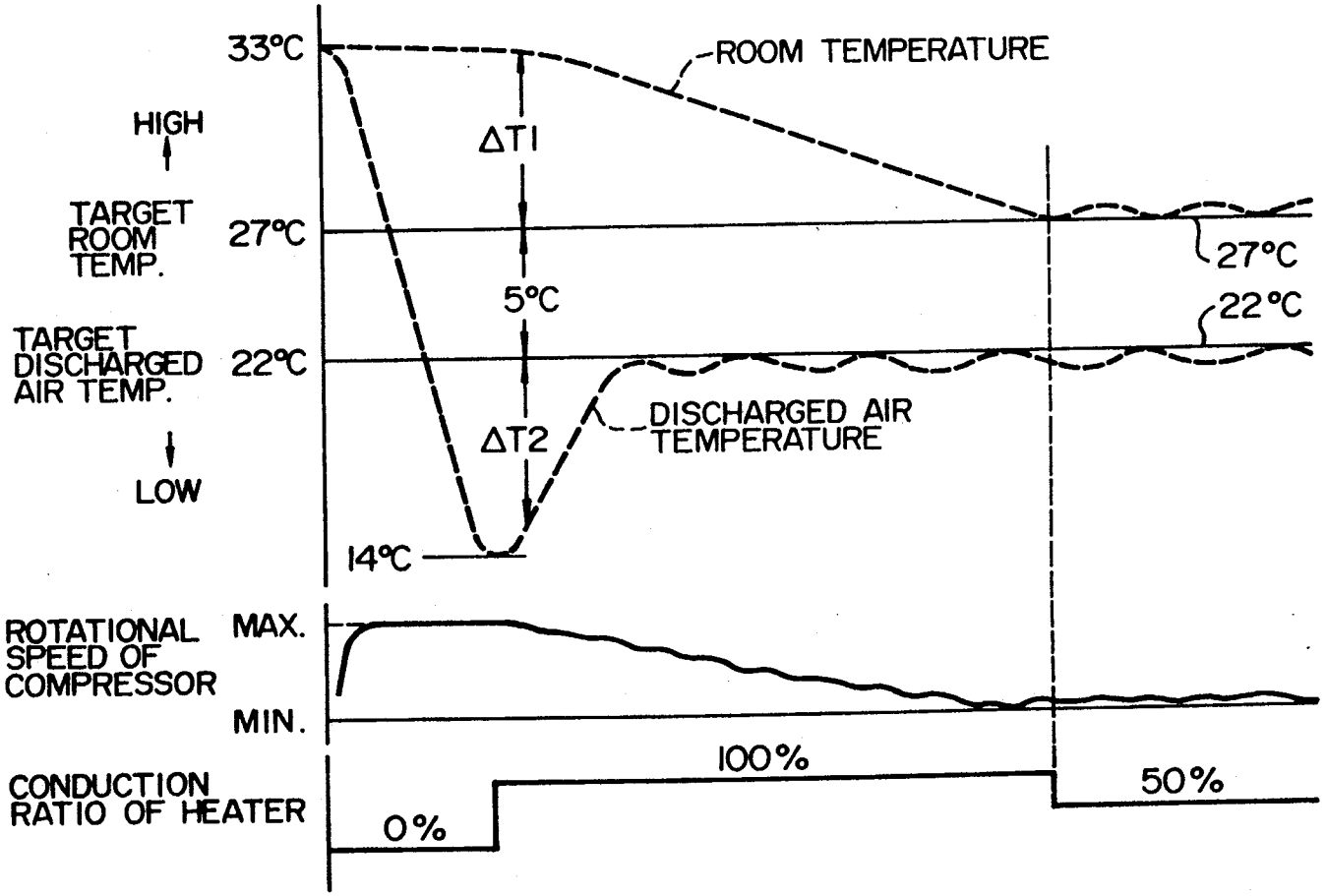
FIG. 7 is a time chart used for explaining a temperature control conducted by the control method of the embodiment according to the present invention.

Next, FIG. 7 illustrates changes in the room temperature, the discharged air temperature and the rotational speed of the compressor 5 made by the operation of the foregoing embodiment of the present invention.

Suppose as illustrated FIG. 7 that the actual room temperature is at 33° C. and the target room temperature is at 27° C. A target discharged air temperature, therefore, is calculated as 27−5=22 (°C.), as explained above.

Figure 1:
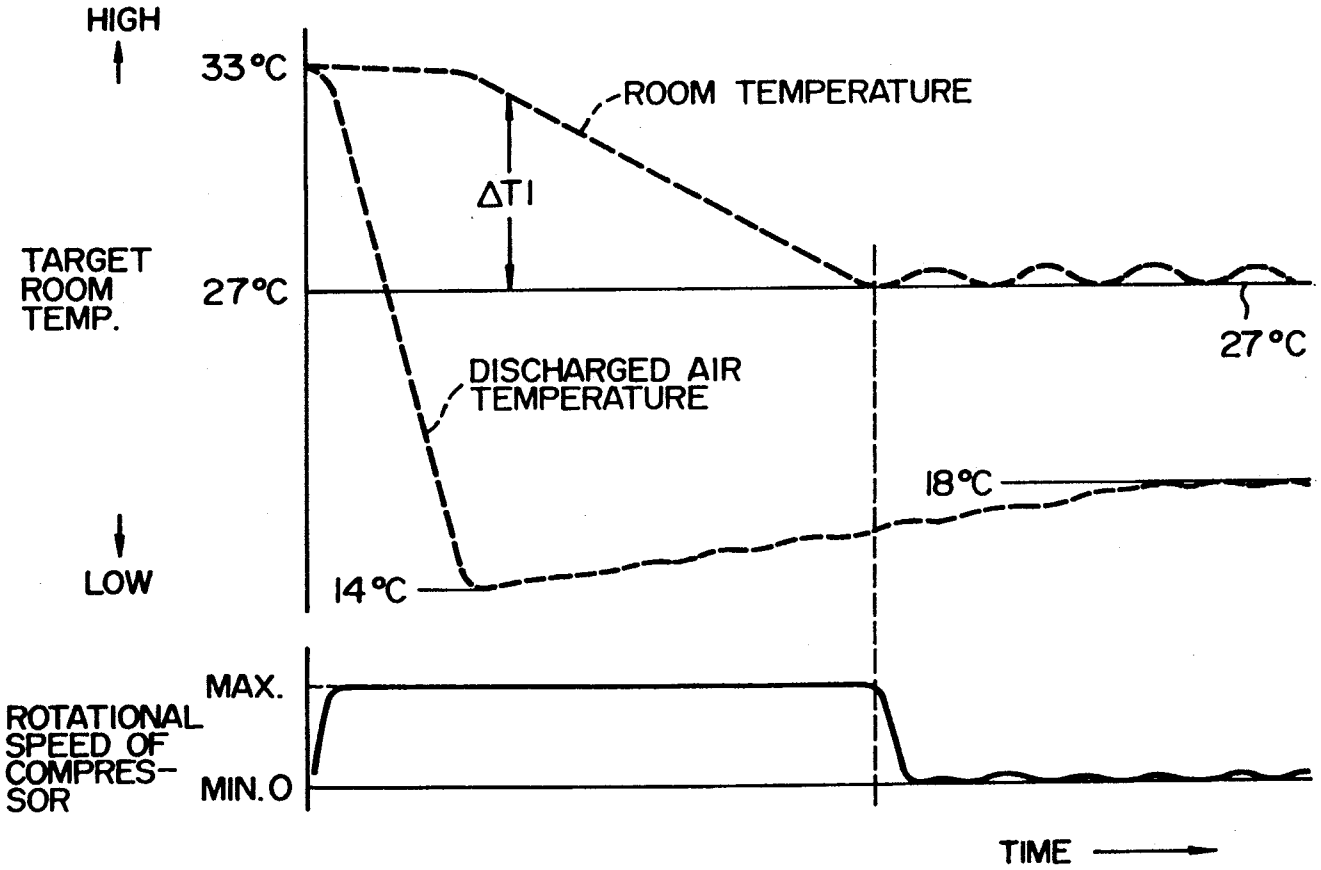
FIG. 1 is a time chart used for explaining a temperature control performed by a conventional air conditioning apparatus.

When the aforementioned cooling operation is started in this situation, since the temperature difference $\Delta T1$ in the equation (1) is extremely large (the second term $\alpha \cdot \Delta T2$ of the right side of the equation (1) is positive), the compressor 5 is rotated at a maximum speed, whereby the heat exchanger operates at its maximum cooling capacity to rapidly cool down the air to be discharged. When the discharged the air is cooled to the possible lowest temperature (it is supposed to be 14° C. in this embodiment), the heater 6 conducts substantially with the conduction ratio of 100% at this time. The air to be discharged is thereby heated, causing its temperature to rise. The room temperature in turn falls rather slowly compared with the discharged air temperature as the discharged air is cooled. Particularly, the cooled air is heated by the heater 6 before being discharged, so that the room temperature falling rate is a bit lower compared with that of the conventional air conditioning apparatus shown in FIG. 1.

As the actual room temperature falls and the discharged air temperature fall below the target discharged air temperature (i.e., $\Delta T2 > 0$), the rotational speed of the compressor 5 is decreased. However, the discharged air temperature is lower than the target room temperature and accordingly lower than the room temperature, thereby causing the room temperature to fall gradually.

The discharged air temperature is gradually raised by the heater 6 and finally reaches the target discharged air temperature. At this time, the actual room temperature continue to gradually fall and the rotational speed of compressor 5 is also being decreased. However, if the discharged air temperature is to be additionally raised, the term $\alpha \cdot \Delta T2$ in the foregoing equation (1) becomes negative, thereby increasing the temperature difference $\Delta T$ and also increasing the rotational speed of the compressor 5, which results in lowering the discharged air temperature. The rotational speed of the compressor 5 tends to be lowered as the room temperature becomes lower. However, if the discharged air temperature is to exceed the target discharged air temperature, the rotational speed of the compressor 5 is increased to lower the discharged air temperature. If the discharged air temperature becomes lower than the target discharged air temperature, the rotational speed of the compressor 5 is decreased to raise the discharged air temperature. In other words, the rotational speed of the compressor 5 is varied in order to stabilize the discharged air temperature in vicinity of the target discharged air temperature and is decreased with the falling room temperature.

Afterward, the actual room temperature reaches the target room temperature of 27° C., where the compressor 5 is operated substantially at the minimum rotational speed. The conduction ratio of the heater 6 in turn is switched from 100% to 50%. In a conventional air conditioning apparatus without the heater, when a compressor is rotated at a minimum rotational speed, a discharged air temperature is merely raised to 18° C., as explained in connection with FIG. 1. On the contrary, in this embodiment, when the compressor 5 is rotated at the minimum rotational speed, the conduction of the heater 6, although with the conduction ratio of 50%, can raise the discharged air temperature to a value sufficiently higher than 18° C.

After the room temperature has reached the target room temperature, since the compressor 5 is maintained at a low rotational speed, the discharged air temperature tends to become higher than the target discharged air temperature. Nevertheless, if the former is about to exceed the latter, the term $\alpha \cdot \Delta T2$ in the foregoing equation (1) becomes negative causing an increase of the temperature difference $\Delta T$, which leads to increase the rotational speed of the compressor 5 by operation of the PI control to lower the discharged air temperature. Then, with the falling of the discharged air temperature, the temperature difference $\Delta T$ in the equation (1) is reduced, whereby the rotational speed of the compressor 5 is decreased to raise the discharged air temperature. Although this response is, of course, not rapid, such fluctuations in the discharged air temperature affect the room temperature. This fluctuation in the room temperature, however, appears in the temperature difference $\Delta T$ in the equation (1) and is suppressed to a small value by the PI control for the compressor 5.

As described above, the room temperature and the discharged air temperature are stabilized in vicinity of the target room temperature and the target discharged air temperature, respectively. Upon starting up the air conditioning apparatus, although the discharged air is cooled down to a minimum temperature, this period is very short, so that the discharged air is rapidly heated to an appropriate target discharged air temperature by the heater 6 driven with the conduction ratio of 100%. It is therefore possible to prevent extremely cooled discharged air, which may cause a person to feel chilly, from blowing off over an entire operation period substantially from the start-up of the air conditioning apparatus. Also, after the room temperature has reached the set desired temperature value, the conduction ratio of the heater 6 is decreased to thereby maintain the discharged air temperature in vicinity of the target discharged air temperature as well as to reduce power consumption. Further, even after a normal operation has started, tepid discharged air will never blow off, thus providing a pleasant cooling.

It should be noted that the values and table employed in the above explanation of the embodiment are examples for explanation, and other values and tables may be used.

According to the present invention as described above, a room temperature as well as a discharged air temperature can be stabilized at predetermined values, thereby providing pleasant cooling effects without giving a chilly feeling due to the blowing of an excessively cooled air.

What is claimed is:

1. A method of controlling a cooling operation in an air conditioning apparatus including a compressor for a room, comprising the steps of:

suctioning and cooling air in said room;

measuring a first air temperature of said room and a second temperature of cooled air discharged from said air conditioning apparatus to said room;

determining a first difference value corresponding to a difference between the measured first air temperature of said room and a first target temperature of the room;

determining a second difference value corresponding to a difference between a second target temperature of the discharged air from said air conditioning apparatus less than said first target temperature of the room by a predetermined value and the measured second temperature of the cooled discharged air from said air conditioning apparatus;

generating a control signal corresponding to a difference between said first difference value and said second difference value; and controlling a rotational speed of said compressor of said air conditioning apparatus in accordance with said control signal and the measured first air temperature of said room, so as to maintain the difference between said first target temperature of the room and said second temperature to be a predetermined constant value.

2. A method according to claim 1 further including the steps of:

heating the cooled air to a third temperature, before the cooled air is discharged, after a predetermined time period has elapsed from a start-up of the cooling operation; and heating the cooled air to a fourth temperature, said fourth temperature being less than said third temperature, when the measured first air temperature in said room has reached said first target temperature of the air in said room.

3. A control method according to claim 1, wherein said second temperature is measured at an air discharge port of an indoor heat exchanger of said air conditioning apparatus.

4. A control method according to claim 1, wherein said rotational speed of said compressor is controlled in accordance with a PI control signal, said PI control signal including a proportional control value and a integral control value, said proportional control valve corresponding to the difference between the first difference value and the second difference value, said integral control value corresponding to the measured first air temperature sampled at predetermined intervals, wherein said PI control signal is determined by a sum of a first rotational speed indicative of said proportional control value and a second rotational speed indicative of said integral control value, said proportional control value being obtained from a table containing previously determined values of rotational sppeds corresponding to the difference between the first difference value and the second difference value, and wherein said integral control value is obtained by adding a first predetermined value to the first rotational speed indicative of said proportional control value when a difference between of the first air temperature measured at a first time $t_1$ and the first air temperature measured at a second time $t_2$ exceeds a predetermined temperature value and by subtracting a second predetermined value from the first rotational speed indicative of said proportional control value when the difference between the first air temperature measured at the first time $t_1$ and the first air temperature measured at the second time $t_2$ is below the predetermined temperature value.

5. An air conditioning apparatus utilizing a vapor compression cycle to cool a coolant and perform a heat exchange between air and the coolant through a heat exchanger to cool the air in a room, comprising:

a first temperature sensor for measuring a first air temperature of the air in said room;

a second temperature sensor for measuring a second air temperature of the air cooled by said air conditioning apparatus and discharged to said room;

means for setting a first target temperature for the air in the room and a second target temperature for the air discharged to said room, said second target temperature being less than said first target temperature by a predetermined value;

means for determining a first difference value corresponding to a first difference between the first air temperature in said room measured by said first sensor and said first target temperature for the room temperature set by said setting means;

means for determining a second difference value corresponding to a second difference between said second target temperature for the discharged air set by said setting means and the second air temperature measured by said second temperature sensor;

means for generating a control signal corresponding to a difference between said first difference value and said second difference value; and control means for controlling a rotational speed of an compressor of said air conditioning apparatus in accordance with said control signal and the first target temperature for the room nd the second air temperature to be a predetermined constant value.

6. An air conditioning apparatus according to claim 5, further including a heater arranged near an air discharge port of said heat exchanger for heating the air passing through said heat exchanger, and wherein said control means further includes:

means for operating said heater so that said heater only operates after a predetermined time period from the start-up of said air conditioning apparatus; and means for adjusting a heating temperature of said heater when the first air temperature in said room measured by said first sensor has reached said first target temperature in said room.

* * * * *